US010362384B2

(12) United States Patent
Yun

(10) Patent No.: US 10,362,384 B2
(45) Date of Patent: Jul. 23, 2019

(54) EARPHONE COVER

(71) Applicant: SPIGEN KOREA CO., LTD., Seoul (KR)

(72) Inventor: Sun Woo Yun, Seoul (KR)

(73) Assignee: SPIGEN KOREA CO., LTD., Seoul (KR)

( * ) Notice: Subject to any disclaimer, the term of this patent is extended or adjusted under 35 U.S.C. 154(b) by 0 days.

(21) Appl. No.: 15/957,788

(22) Filed: Apr. 19, 2018

(65) Prior Publication Data

US 2018/0310089 A1 Oct. 25, 2018

Related U.S. Application Data

(60) Provisional application No. 62/487,456, filed on Apr. 19, 2017.

(51) Int. Cl.
*H04R 1/10* (2006.01)

(52) U.S. Cl.
CPC ..... *H04R 1/105* (2013.01); *H04R 1/1016* (2013.01); *H04R 1/1058* (2013.01)

(58) Field of Classification Search
CPC .. H04R 1/105; H04R 2420/07; H04R 1/1058; H04R 1/1091; H04R 1/1041; H04R 1/1033; H04R 1/1066; H04R 1/1083; H04R 1/1008; H04R 1/10; H04R 1/1025; H04R 2201/107
USPC ..... 381/380, 370, 381, 384
See application file for complete search history.

(56) References Cited

U.S. PATENT DOCUMENTS

| | | | | |
|---|---|---|---|---|
| 7,916,888 | B2 | 3/2011 | Sapiejewski et al. | |
| 8,249,287 | B2 | 2/2012 | Silvestri et al. | |
| 8,311,253 | B2 | 11/2012 | Silvestri et al. | |
| 8,600,096 | B2 | 12/2013 | Lin | |
| 8,630,436 | B2 | 1/2014 | Berg | |
| 8,682,001 | B2 | 3/2014 | Annunziato et al. | |
| 8,737,669 | B2 | 5/2014 | Monahan et al. | |
| 9,082,388 | B2 | 7/2015 | Annunziato et al. | |
| 9,269,432 | B2 | 2/2016 | Faraoni et al. | |
| 9,635,452 | B2 | 4/2017 | Cheng et al. | |
| 9,792,893 | B1 | 10/2017 | Gauger, Jr. et al. | |
| 9,813,794 | B2 | 11/2017 | Cheng et al. | |
| 9,854,345 | B2 | 12/2017 | Briggs | |
| 2014/0119589 | A1* | 5/2014 | Wyzisk | H04R 1/105 381/380 |
| 2017/0094399 | A1* | 3/2017 | Chandramohan | A45C 13/02 |
| 2017/0257714 | A1* | 9/2017 | Han | H04R 1/105 |

(Continued)

*Primary Examiner* — Curtis A Kuntz
*Assistant Examiner* — Julie X Dang
(74) *Attorney, Agent, or Firm* — Heedong Chae; Lucem, PC

(57) ABSTRACT

An earphone cover for an earphone includes an ear bud skin and an extension. The earphone includes an ear bud with a stem, and the earphone is inserted into a user's ear canal. The stem extends from the ear bud and a primary speaker outlet is formed on the ear bud. The ear bud skin substantially covers the ear bud of the earphone and increases friction between the ear bud and user's ear (provides an interface that increases friction between the ear bud and the user's ear) and the extension extends from the ear bud skin for more secure fit of the earphone to user's ear. The earphone cover is sufficiently flexible and elastic to accept insertion of the earphone therein along with being made of a material to provide a comfortable fit too.

20 Claims, 11 Drawing Sheets

(56) References Cited

U.S. PATENT DOCUMENTS

| | | | | |
|---|---|---|---|---|
| 2018/0092601 | A1* | 4/2018 | Wagner | A61B 5/6844 |
| 2018/0124489 | A1* | 5/2018 | Aljuwayed | H04R 1/1016 |

* cited by examiner

EARPHONE COVER

CROSS-REFERENCE TO RELATED APPLICATIONS

This application claims priority to U.S. provisional patent application No. 62/487,456, filed on Apr. 19, 2017, the disclosures of which are incorporated herein by reference in their entirety.

FIELD OF THE INVENTION

The present invention relates to an earphone cover for an earphone, and more specifically an earphone cover, including an ear bud skin and an extension, for an earphone having an ear bud and a stem. The ear bud skin has first and second openings. Through these openings and its shape, the ear bud skin receives the ear bud. The first opening surrounds a primary speaker outlet of the earphone and the stem passes through the second opening in order for the earphone to be received in the earphone cover.

BACKGROUND OF THE INVENTION

Apple Inc.™ has introduced in September, 2016 wireless earbuds or earpieces called AirPods™ 100, which is compatible with iPhone™ or iPad™. See http://www.apple.com/shop/product/MMEF2AM/A/airpods. As illustrated in FIGS. 1 and 2, AirPods™ 100 are ear-bud style earpieces 100 having a ear bud 110 and a stem 120 and can be charged in a charging case (not shown) which has its own battery.

Earphones 100 such as AirPods 100 include an ear bud 110 and a stem 120. A primary speaker outlet 130 is formed on the ear bud 110 and the ear bud 110 further includes first and second secondary speaker outlets 131, 132. Grilles are formed on each of the speaker outlets 130, 131, AirPods 100 further includes sensors 140, 141 to detect whether or not AirPods 100 are in user's ear. The stem 120 adopts a longitudinal profile to store an antenna and battery therein. When a user wears an Airpod, the stem 120 is shown to be downwardly longitudinal and/or downwardly extends from the ear bud 110. The ear bud 110 is constructed to be inserted into user's ear canal 210.

However, AirPods 100 do not securely fit in a user's ear canal and it is possible for the AirPods 100 to slip out of the user's ear and get lost.

The present invention is directed to overcome such a disadvantage and provides a number of other advantages when adopted with wireless ear-bud style earpieces 100 having an ear bud 110 and a stem 120.

SUMMARY OF THE INVENTION

The present invention is directed to an earphone cover, including an ear bud skin and an extension, for an earphone having an ear bud and a stem. The ear bud skin has first and second openings. The ear bud skin receives the ear bud. The first opening surrounds a primary speaker outlet of the earphone and the stem passes through the second opening in order for the earphone to be received in the earphone cover.

The object of the present invention is to provide an earphone cover for an earphone where the earphone includes an ear bud and a stem. The ear bud is inserted into user's ear canal and the stem extends from the ear bud where, additionally, a primary speaker outlet is formed thereon. Furthermore, the earphone cover includes an ear bud skin that substantially covers the ear bud of the earphone and increases the friction between the ear bud and user's ear. An extension extends from the ear bud skin for a more secure fit of the earphone to a user's ear. The earphone cover is sufficiently flexible and elastic to accept insertion of the earphone therein.

Another object of the present invention is to provide an earphone cover for an earphone where the earphone includes an ear bud having a primary speaker outlet and a stem and where the ear bud is inserted into user's ear canal and the stem downwardly extends from the ear bud, the earphone cover including an ear bud skin for substantially covering the ear bud of the earphone and increasing friction between earphone cover and user's ear; and an extension which outwardly extends from the ear bud skin for more secure fit of the earphone to user's ear. The ear bud skin includes a first opening and a second, opening.

The first opening is sized to allow passage of the stem and expands enough to allow passage of the ear bud; the second opening is sized to allow passage of the stem, but the second opening is not sized or does not expand enough to allow passage of the ear bud. The first opening includes an outlet surrounding portion and an extended portion. The outlet surrounding portion substantially surrounds the primary speaker outlet and the extended portion longitudinally extends from the outlet surrounding portion. In addition, the extended portion is formed on about an opposite side of the second opening. The earphone cover is sufficiently flexible and elastic to accept insertion of the earphone therein.

Still another object of the present invention is to provide a method for using an earphone cover constructed for an earphone. The method may include steps for easy insertion of the earphone cover into the earphone. The method may further include steps for easy removal of the earphone cover from the earphone. The steps for insertion include the step of inserting the stem into the second opening; the step of respectively holding the stem and the extension and pulling and rotating the extension away from the stem to insert the ear bud into the ear bud skin; and the step of adjusting the ear bud skin to align an orientation of the ear bud skin such that the ear bud skin corresponds to the ear bud and the first opening surrounds the primary speaker outlet. In addition, the steps for removal includes the step of respectively holding the stem and the extension; the step of rotating the extension in order for the ear bud to be removed from the ear bud skin; and the step of holding the ear bud and taking the stem out of the second opening.

The advantages of the present invention are: (1) the earphone cover of the present invention provides a secure fit of the earphone into the ear; (2) it is very easy and Convenient to insert and remove the earphone into and from the earphone cover; (3) once the earphone is received in the earphone cover, the earphone is well secured therein by a friction fit; (4) once the earphone is received in the earphone cover and secured therein by a friction fit, the earphone can be secured into user's ear by a friction fit between the earphone cover and user's ear; (5) the earphone cover has an extension which fits in and is secured to cymba conchae of user's ear, and thus, the extension provides enhanced secure fit of the earphone into user's ear; (6) the earphone, in, the alternative, has an extension which fits in and is secured to the triangular fossa of the user's ear, and thus, the extension provides enhanced secure fit of the earphone into the user's ear; (7) the earphone cover of the present inventions keeps AirPods secure and anchored in the ear; (8) the earphone cover is constructed as one-piece of soft material, preferably silicone, and thus, it can be manufactured by a molding process and the manufacturing cost is low; and (9) the soft-material composition of the earphone cover also provides a comfortable fit between the earphone-inserted earphone cover and the user's ear. Despite advantages (2) and (3) requiring opposite features of the earphone cover, the earphone cover of the present invention is shown to achieve both.

Although the present invention is briefly summarized, the fuller understanding of the invention can be obtained by the following drawings, detailed description and appended claims.

BRIEF DESCRIPTION OF THE DRAWINGS

These anti other features, aspects and advantages of the present invention will become better understood with reference to the accompanying drawings, wherein.

DETAILED DESCRIPTION EMBODIMENTS OF THE INVENTION

Figure 1:
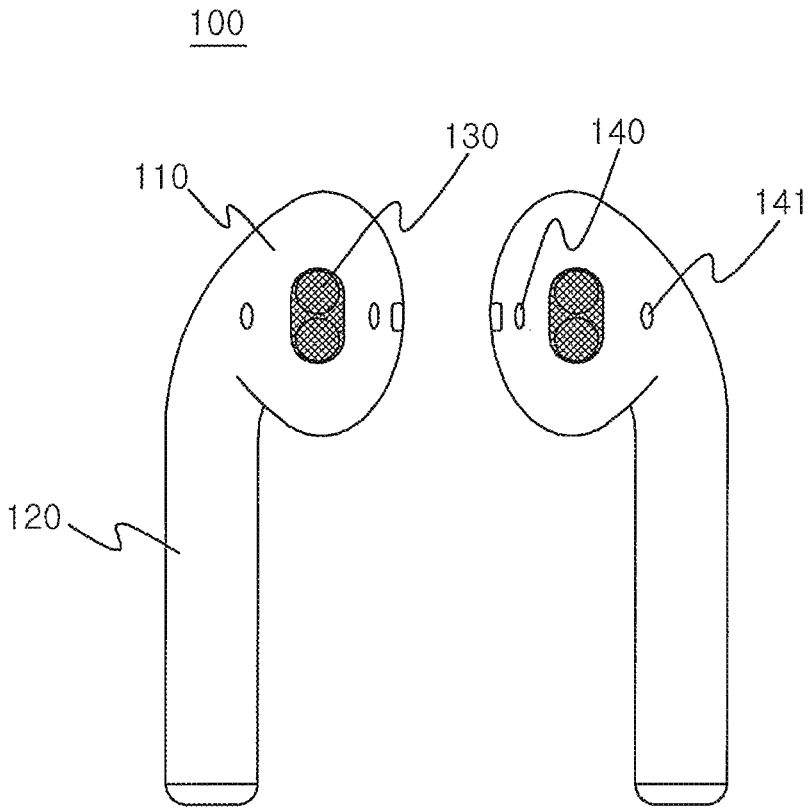
FIGS. 1 and 2 show Apple Inc.™'s AirPods™.

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

As illustrated in FIGS. 1-3 and 4A and 4B, an earphone cover (10) for an earphone (100) where the earphone (100) (see FIGS. 1 and 2) includes an ear bud (110) having a primary speaker outlet (130) and a stem (120), and where the ear bud (110) is inserted into user's ear canal (210) (see FIG. 3) and the stem (120) extends from the ear bud (110), the earphone cover (10) (see FIGS. 4A and 4B) includes an ear bud skin (20) for substantially covering the ear bud (110) of the earphone (100) and increasing friction between the earphone cover (10) and user's ear (200); and an extension (30) which extends from the ear bud skin (20) for more secure fit of the earphone (100) to user's ear (200). The earphone cover (10) is sufficiently flexible and elastic to accept insertion of the earphone (100) therein.

Figure 2:
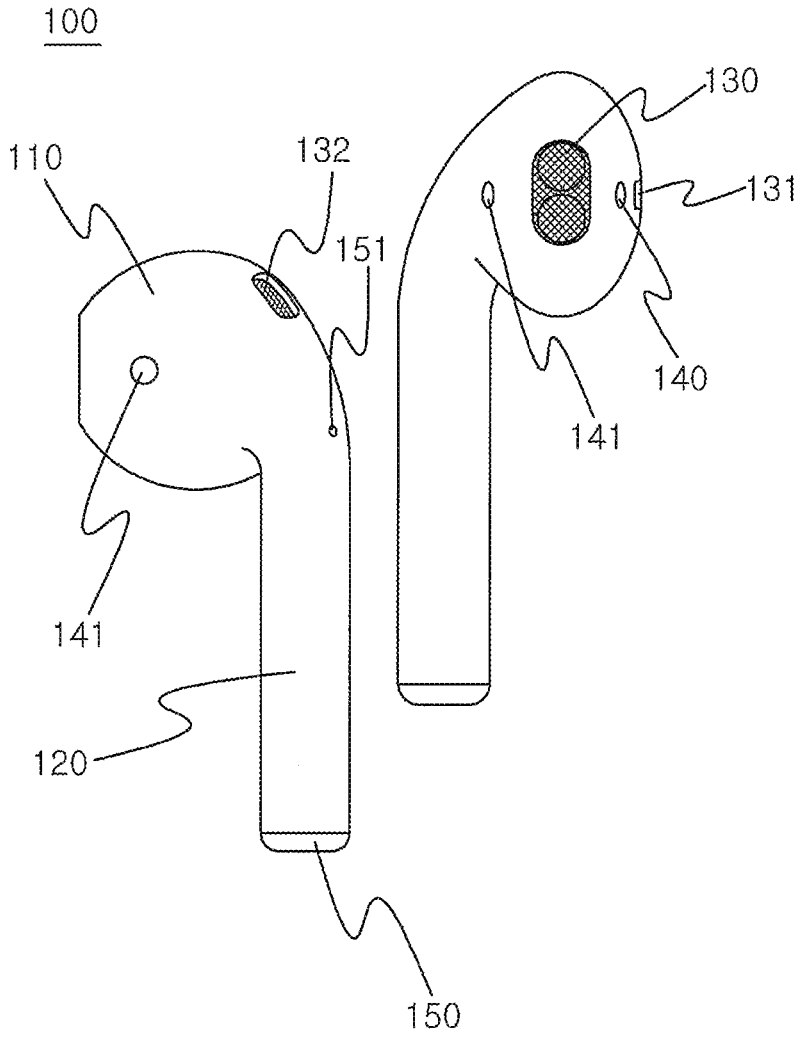
Figure 3:
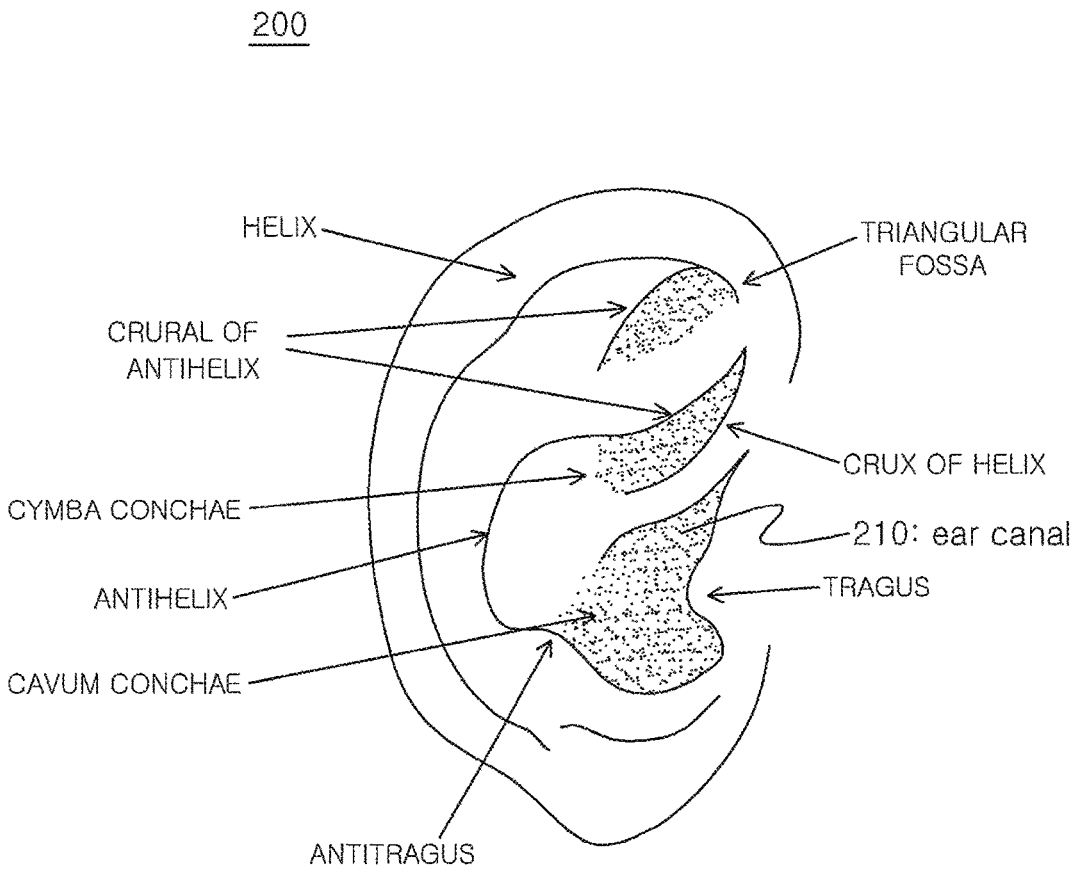
FIG. 3 shows anatomy of a person's ear.

Further, as shown in FIGS. 1 and 2, the speaker outlet is where the sound is output and AirPods (100) has three speaker outlets—one primary speaker outlet (130) and the first and second secondary speaker outlets (131, 132). Each speaker outlet has a grille. Furthermore, AirPods has two proximity sensors (140, 141). The first secondary speaker outlet (131) is next to the proximity sensor 140. AirPods further includes a primary microphone 150 and a secondary microphone 151.

Figure 4A:
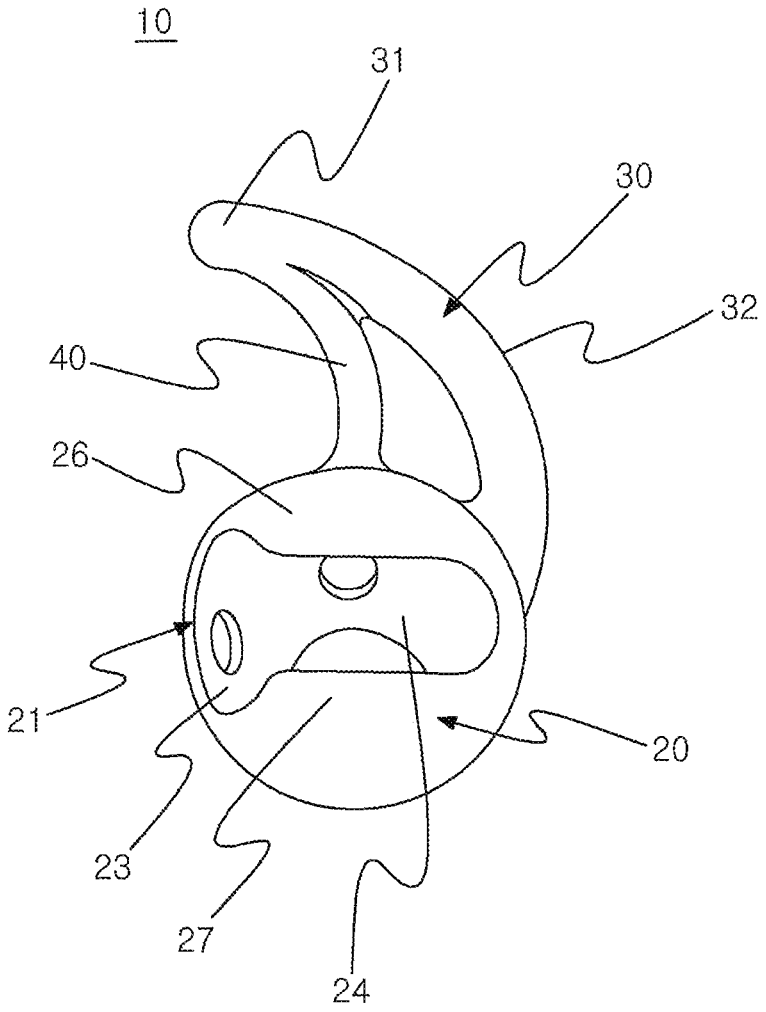
FIGS. 4A and 4B show the earphone cover of the present invention.
Figure 4B:
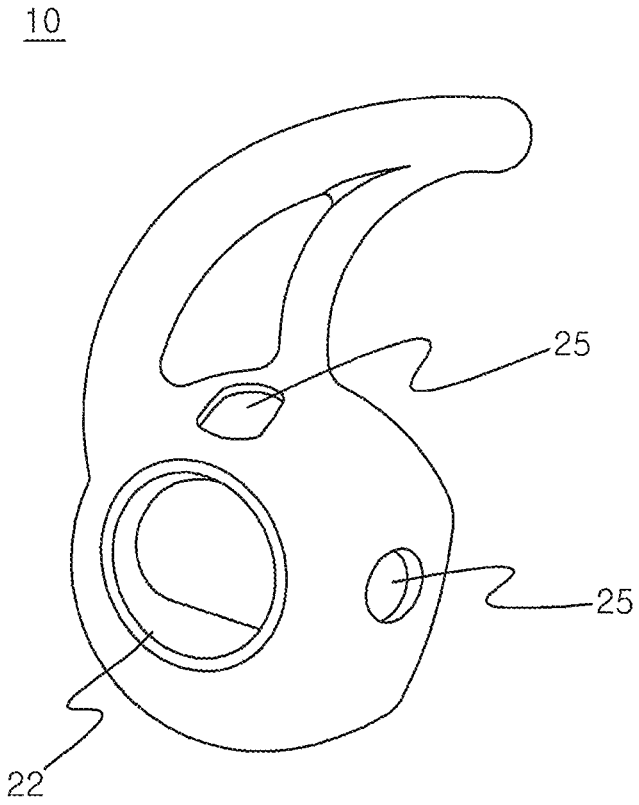

FIGS. 4A and 4B illustrate an ear bud skin (20) that substantially covers the ear bud (110) of the earphone (100) to increase friction between the ear phone cover (10) and cavum conchae or ear canal of user's ear (200).

The earphone cover (10) has sufficient stiffness or rigidity to securely retain the inserted earphone (100) and friction between the earphone cover (10), and the earphone (100) is of sufficient strength to prevent slippage of the earphone (100) out of the earphone cover (10).

The ear bud skin (20) includes a first opening (21) and a second opening (22) (see FIGS. 4A and 4B). The first opening (21) is sized to allow passage of the stem (120) and expands enough to allow passage of the ear bud (110) whereas the second opening (22) is sized to allow passage of the stem (120), but the second opening (22) is not sized or does not expand enough to allow passage of the ear bud (110).

Figure 5:
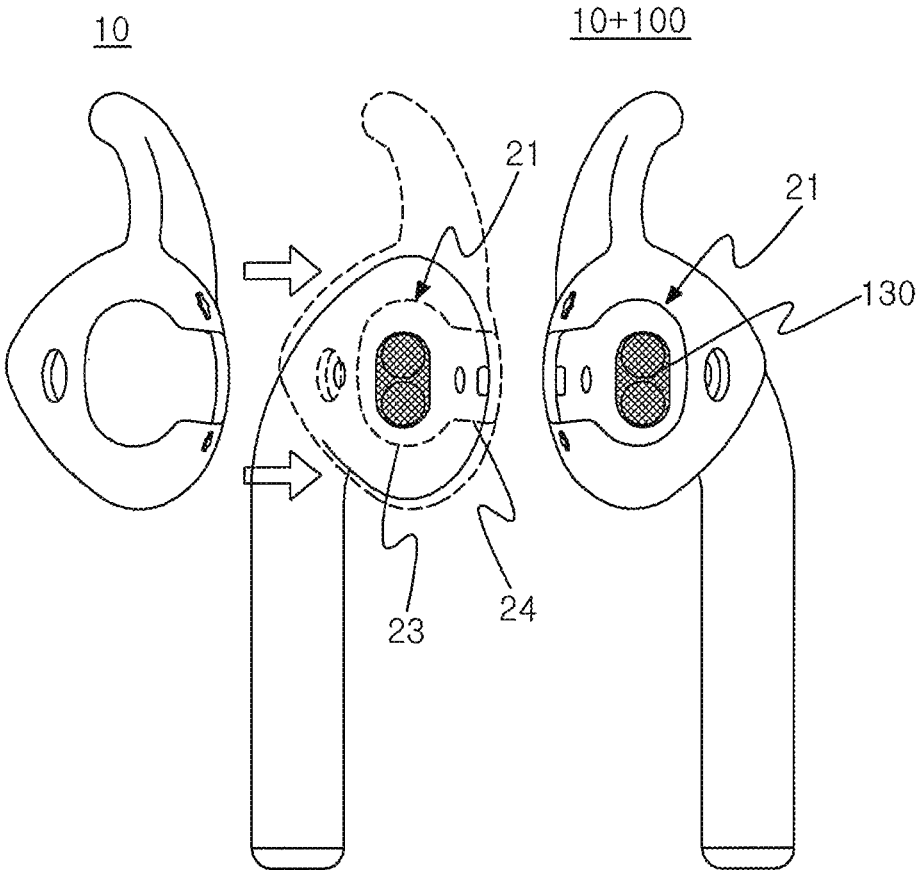
FIG. 5 shows the earphone cover having the earphone therein according to the present invention.

FIG. 5 illustrates the first opening (21) substantially surrounding the primary speaker outlet (130). "Surround" here means the boundary of the opening (21) encircles more than half the boundary of the speaker outlet (130).

Further, FIG. 5 depicts the first opening (21) that includes an outlet surrounding portion (23) and an extended portion (24) with the extended portion (24) extending from the outlet surrounding portion (23).

The outlet surrounding portion (23) substantially surrounds the primary speaker outlet (130) and the extended portion (24) may longitudinally extend from the outlet surrounding portion (23). The outlet surrounding portion (23) may or may not surround the whole primary speaker outlet (130), and the outlet surrounding portion (23) may Partially overlap with the Primary speaker outlet (130).

The ear bud skin (20) (see FIG. 4A) further includes a first flap (26) and a second flap (27) formed by the outlet surrounding portion (23) and the extended portion (24), and where the first and second flaps (26, 27) are formed on opposite sides of the extended portion (24). The first and second flaps (26, 27) are substantially on a same plane. In other words, the first and second flaps. (26, 27) are substantially on a same flat or rounded plane.

The first and second flaps (26, 27) become wide open when inserting or removing the earphone (100) into or from the earphone cover (10).

The first opening (21) includes an outlet surrounding portion (23) and an extended portion (24) with the extended portion (24) extending from the outlet surrounding portion (23).

Besides, the outlet surrounding portion (23) substantially surrounds the primary speaker outlet (130) and the extended portion (24) longitudinally extends from the outlet surrounding portion (23). Furthermore, the first and second flaps (26, 27) provide additional expandability to the outlet surrounding portion (23) and the extended portion (24) of the first opening (21) thereby increasing the ease of sizing the first opening (21) to permit passage of the ear bud (110) through it.

The earphone (100) further includes a first sensor (140) and a first secondary speaker outlet (131) and the extended portion (24) is placed on the first sensor (140) and the first secondary speaker (131).

The earphone (100) further includes a second sensor (141) and a second secondary speaker outlet (132) and the ear bud skin (20) further includes openings (25) respectively for the second sensor (141) and the second secondary speaker outlet (132).

With respect to the anatomy of the ear (see FIG. 3), the antihelix describes a curve around a deep, capacious cavity, the concha, which is partially divided into two parts by the crus of the helix; the upper part is termed the cymba conchae, the lower part the cavity of concha (cavum conchae).

Figure 6A:
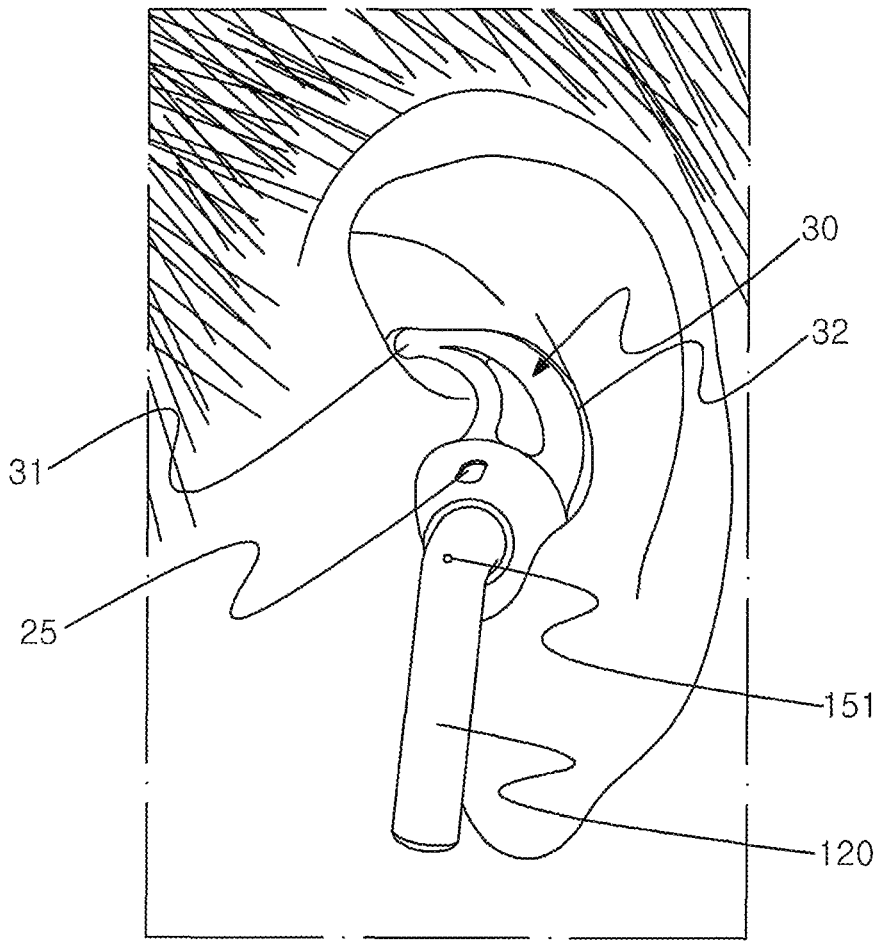
FIGS. 6A and 6B show the earphone cover having the earphone therein worn by a user, illustrating the stem downwardly hanging and the extension retained in cymba conchae or the triangular fossa of user's ear respectively.
Figure 6B:
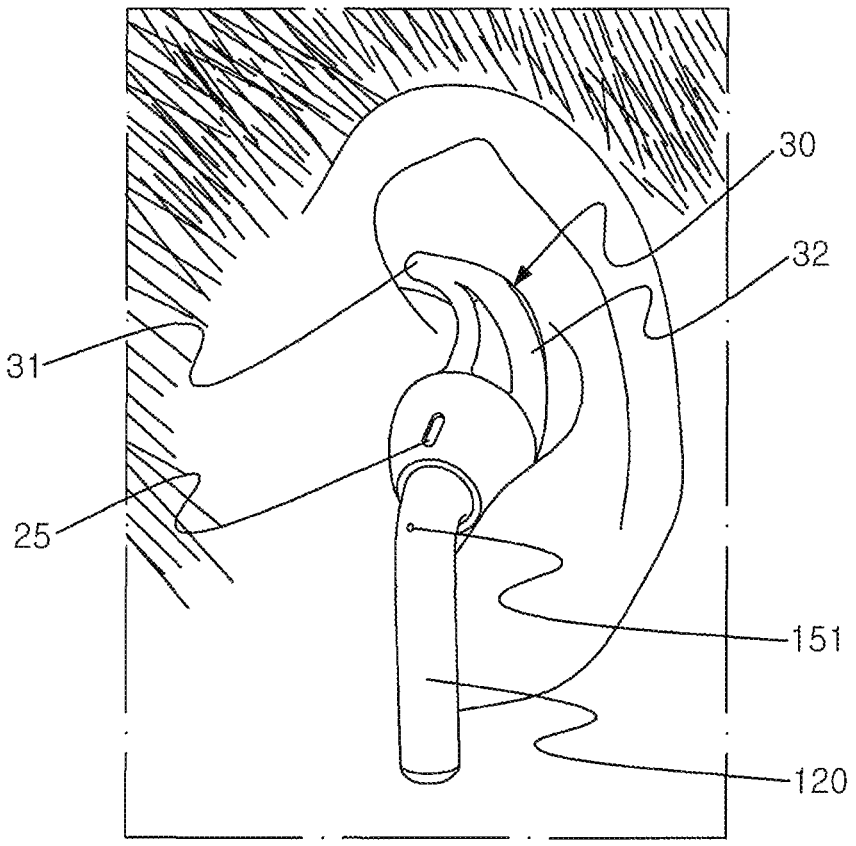

FIG. 6A illustrates the extension (30) having an end (31) which fits in cymba conchae of user's ear (200). Furthermore, the extension (30) has a curvature (32) corresponding with an antihelix of user's ear (200). Alternatively, as shown in FIG. 6B, the end (31) can be constructed to fit in the triangular fossa of the user's ear (200).

The extension (30) longitudinally extends to form a curve (32) and the earphone cover (10) further include an extension support (40) which longitudinally extends from the ear bud skin (20) toward the end (31) of the extension (30). The extension support (40) gives shape to the extension (30) so that the extension (30) can effectively fit in cymba conchae of user's ear and correspond to the antihelix of user's ear. Without the extension support (40), the extension (30) will freely move thereby precluding a comfortable fit of the earphone cover (10) and earphone (100) to the user's ear (200).

The earphone cover (10) is constructed as one-piece of soft material or any other elastic material. The soft material is flexible and elastic and has the property of certain degree of friction against hard plastic surface to allow insertion and removal of the earphone (100) into or from the earphone cover (10) and maintain the orientation of the earphone cover (10) against the inserted earphone (100). Preferably, the earphone cover (10) is made of silicone, to provide not only a secure fit between the earphone (100) with the earphone cover (10) and the user's ear but also a comfortable fit.

The earphone (100) (see FIGS. 1 and 2) further includes a secondary microphone (151) formed on the stem (120) and the earphone cover (10) does not cover the secondary microphone (151).

Figure 7:
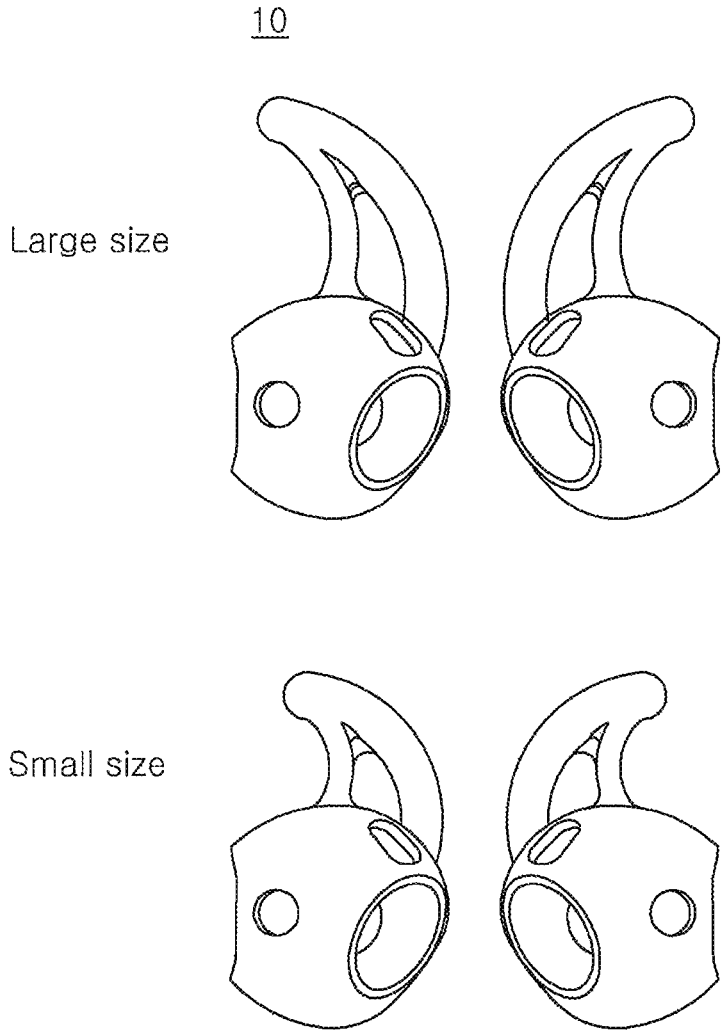
FIG. 7 shows two sizes—small and large—of the earphone cover.

FIG. 7 illustrates how the earphone cover (10) can be manufactured into different sizes to fit different profiles of users' ears. As often is the case, some users may have smaller ears (200) for which the smaller earphone covers (10) provide a secure and comfortable fit and other users may have larger ears for which the larger earphone covers (10) would provide the same.

Further, earphone covers (10) can come in a variety of different colors that may correspond to or coordinate with the earphone (100) color or be the color that fits with a user's aesthetic preferences.

The preferred embodiment of the present invention includes an earphone cover (10) for an earphone (100) with the earphone (100) having an ear bud (110) and a stem (120) and where the ear bud (110) has a primary speaker outlet (130) formed therein and the ear bud (100) is inserted into user's ear canal (210) with the stem (120) downwardly extending from the ear bud (110), the earphone cover (10) including an ear bud skin (20) for substantially covering the ear bud (110) of the earphone (100) and increasing friction between the ear bud (110) and user's ear (200); and an extension (30) which upwardly extends from the ear bud skin (20) for more secure fit of the earphone (100) to user's ear (200). The ear bud skin (20) includes a first opening (21) and a second opening (22). The first opening (21) is sized to allow passage of the stem (120) and expands enough to allow passage of the ear bud (110) whereas the second opening (22) is sized to allow passage of the stem (120), but the second opening (22) is not sized or does not expand enough to allow passage of the ear bud (110). Furthermore, the first opening (21) includes an outlet surrounding portion (23) and an extended portion (24). The outlet surrounding portion (23) substantially surrounds the primary speaker outlet (130) and the extended portion (24) longitudinally extends from the outlet surrounding portion (23). The extended portion (24) is formed on about an opposite side of the second opening (22). The earphone cover (10) is sufficiently flexible and elastic to accept insertion of the earphone (100) therein.

The ear bud skin (20) substantially covers the ear bud (110) of the earphone (100) to increase friction between the ear bud (110) and cavum conchae or ear canal of user's ear (200), and the earphone cover (10) has sufficient rigidity to securely retain the inserted earphone (100) and friction between the earphone cover (10) and the earphone (100) is of sufficient strength to prevent slippage of the earphone (100) out of the earphone cover (10).

The extension (30) has an end (31) which fits in cymba conchae of user's ear (200), and the extension (30) has a curvature (32) constructed to substantially correspond with an antihelix of user's ear (290).

Figure 8A:
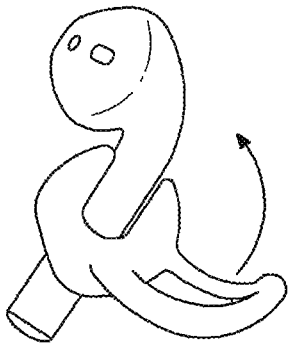
FIGS. 8A, 8B and 8C show the steps to insert the earphone into the earphone cover.
Figure 8B:
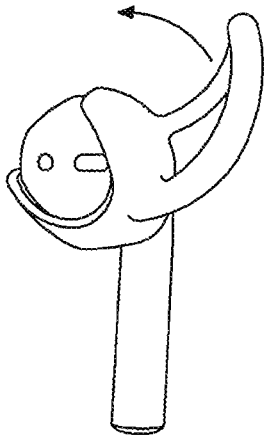
Figure 8C:
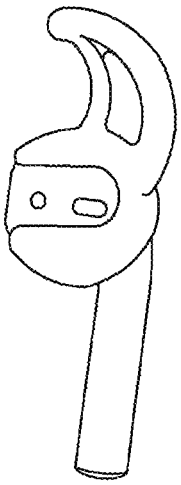

FIGS. 8A-8C illustrate a method to insert the earphone (100) into the earphone cover. The method of inserting an earphone cover (10) to an earphone (100) where the earphone (100) includes an ear bud (110) and a stem (120), where the ear bud (110) has a primary speaker outlet (130) formed therein and where the ear bud (100) is inserted into user's ear canal (210) with the stem (120) downwardly extending from the ear bud (110), where the earphone cover (10) includes an ear bud skin (20) and an extension (30), and where the ear bud skin (20) includes a first opening (21) and a second opening (22), the method including the step of inserting the stem (120) into the first opening (21) and then into the second opening (22); the step of respectively holding the stem (120) and the extension (30) and pulling and rotating the extension (30) away from the stem (120) to insert the ear bud (110) into the ear bud skin (20) through the first opening (21); and the step of adjusting the ear bud skin (20) to align an orientation of the ear bud skin (20) such that the ear bud skin (20) corresponds to the ear bud (110) and the first opening (21) surrounds the primary speaker outlet (130).

Figure 9A:
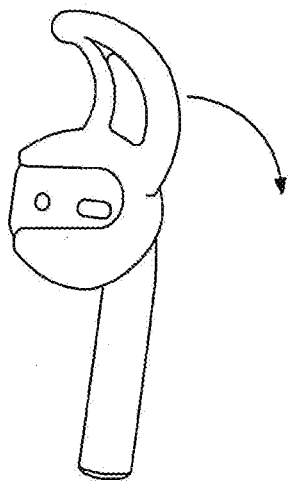
FIGS. 9A, 9B, and 9C show the steps to remove the earphone from the earphone cover.
Figure 9B:
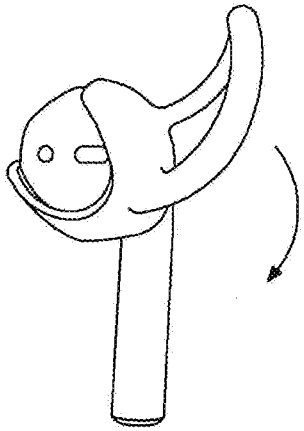
Figure 9C:
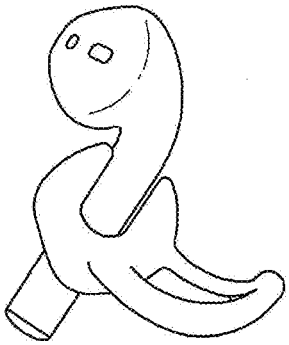

FIGS. 9A-9C illustrate a method to remove the earphone (100) from the earphone cover. The method of removing an earphone cover (10) from an earphone (100) where the earphone (100) includes an ear bud (110) and a stem (120), where the ear bud (110) has a primary speaker outlet (130) formed therein and where the ear bud (100) is inserted into user's ear canal (210) with the stem (120) downwardly extending from the ear bud (110), where the earphone cover (10) includes an ear bud skin (20) and an extension (30), and where the ear bud, skin (20) includes a first opening (21) and a second, opening (22), the method including the step of respectively holding the stem (120) and the extension (30);

the step of rotating the extension (30) in order for the ear bud (110) to be removed from the ear bud skin (20) through the first opening (21); and the step of holding the ear bud (110) and taking the stem (120) out of the second opening (22) and then out of the first opening (21).

By holding and/or rotating the extension (30), insertion and removal of the earphone (100) is now easy and convenient. In addition, the first and second flaps (26, 27) become wide open when inserting or removing the earphone (100) into or from the earphone cover (10). The first and second flaps (26, 27) enable easy and convenient insertion and removal of the earphone (100).

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. An earphone cover (10) for an earphone (100) wherein the earphone (100) is comprised of an ear bud (110) and a stem (120) and wherein the ear bud (110) inserts into user's ear canal (210) and the stem (120) extends from the ear bud (110) wherein a primary speaker outlet (130) is formed on the ear bud (110), the earphone cover (10) comprising:

an ear bud skin (20) for substantially covering the ear bud (110) of the earphone (100); and an extension (30) which extends from the ear bud skin (20) for secure fit of the earphone (100) to user's ear (200), wherein the ear bud skin (20) comprises a first opening (21) and a second opening (22), wherein the first opening (21) is sized to allow passage of the stem (120) and expands enough to allow passage of the ear bud (110), wherein the second opening (22) is sized to allow passage of the stem (120), but the second opening (22) is not sized or does not expand enough to allow passage of the ear bud (110), and wherein the earphone cover (10) is constructed to permit the stem (120) and the ear bud (110) to initially pass through the first opening (21) and then permit the stem (120) pass through the second opening (22) for proper placement of the ear bud (110) within the earphone cover (10).

2. The earphone cover (10) of claim 1, wherein the first opening (21) substantially surrounds the primary speaker outlet (130).

3. The earphone cover (10) of claim 1, wherein the first opening (21) comprises an outlet surrounding portion (23) and an extended portion (24) wherein the extended portion (24) extends from the outlet surrounding portion (23).

4. The earphone cover (10) of claim 3, wherein the outlet surrounding portion (23) substantially surrounds the primary speaker outlet (130) and the extended portion (24) longitudinally extends from the outlet surrounding portion (23).

5. The earphone cover (10) of claim 3, wherein the ear bud skin (20) further comprises a first flap (26) and a second flap (27) formed by the outlet surrounding portion (23) and the extended portion (24), and wherein the first and second flaps (26, 27) are formed on opposite sides of the extended portion (24).

6. The earphone cover (10) of claim 5, wherein the first and second flaps (26, 27) are substantially on a same flat or rounded plane.

7. The earphone cover (10) of claim 3, wherein the earphone (100) further comprises a first sensor (140) and a first secondary speaker outlet (131) and the first sensor (140) and the first secondary speaker (131) are placed on the extended portion (24).

8. The earphone cover (10) of claim 7, wherein the earphone (100) further comprises a second sensor (141) and a second secondary speaker outlet (132) and the ear bud skin (20) further comprises openings (25) respectively for the second sensor (141) and the second secondary speaker outlet (132).

9. The earphone cover (10) of claim 1, wherein the earphone cover (10) is constructed as one-piece of soft material.

10. The earphone cover (10) of claim 9, wherein the earphone cover (10) is made of silicone.

11. The earphone cover (10) of claim 1, wherein the earphone cover (10) is sufficiently flexible and elastic to accept insertion of the earphone (100) therein.

12. The earphone cover (10) of claim 11, wherein the earphone cover (10) is of sufficient rigidity to securely retain the inserted earphone (100) and friction between the earphone cover (10) and the earphone (100) is of sufficient strength to prevent slippage of the earphone (100) out of the earphone cover (10).

13. The earphone cover (10) of claim 1, wherein the ear bud skin (20) substantially covers the ear bud (110) of the earphone (100) to provide increased friction between the ear bud cover (10) and cavum conchae or ear canal of user's ear (200) in comparison to that between the ear bud (110) and cavum conchae without the earphone cover (10).

14. The earphone cover (10) of claim 1, wherein the extension (30) has an end (31) which fits in cymba conchae of user's ear (200), and wherein the extension (30) has a curvature (32) constructed to substantially correspond with an antihelix of user's ear (200).

15. The earphone cover (10) of claim 14, wherein the extension (30) longitudinally extends to form a curve (32) and the earphone cover (10) further comprise an extension support (40) which longitudinally extends from the ear bud skin (20) towards the end (31) of the extension (30).

16. The earphone cover (10) of claim 1, wherein the earphone (100) further comprises a secondary microphone (151) formed on the stem (120) and the earphone cover (10) does not cover the secondary microphone (151).

17. An earphone cover (10) for an earphone (100) wherein the earphone (100) is comprised of an ear bud (110) and a stem (120) and wherein the ear bud (110) plugs into user's ear canal (210) and the stem (120) downwardly extends from the ear bud (110) wherein a primary speaker outlet (130) is formed on the ear bud (110), the earphone cover (10) comprising:

an ear bud skin (20) for substantially covering the ear bud (110) of the earphone (100) and increasing friction between the ear bud (110) and user's ear (200); and an extension (30) which outwardly extends from the ear bud skin (20) for more secure fit of the earphone (100) to user's ear (200), wherein the ear bud skin (20) comprises a first opening (21) and a second opening (22);

wherein the first opening (21) is sized to allow passage of the stem (120) and expands enough to allow passage of the ear bud (110), wherein the second opening (22) is sized to allow passage of the stem (120), but the second opening (22) is not sized or does not expand enough to allow passage of the ear bud (110), wherein the first opening (21) comprises an outlet surrounding portion (23) and an extended portion (24), wherein the outlet surrounding portion (23) substantially surrounds the primary speaker outlet (130) and the extended portion (24) longitudinally extends from the outlet surrounding portion (23), wherein the extended portion (24) is formed on about an opposite side of the second opening (22), wherein the earphone cover (10) is sufficiently flexible and elastic to accept insertion of the earphone (100) therein, and wherein the earphone cover (10) is constructed to permit the stem (120) and the ear bud (110) to initially pass through the first opening (21) and then permit the stem (120) pass through the second opening (22) for proper placement of the ear bud (110) within the earphone cover (10).

18. The earphone cover (10) of claim 17, wherein the earphone cover (10) is of sufficient rigidity to securely retain the inserted earphone (100) and friction between the earphone cover (10) and the earphone (100) is of sufficient strength to prevent slippage of the earphone (100) out of the earphone cover (10), wherein the extension (30) has an end (31) which fits in cymba conchae of user's ear (200), wherein the extension (30) has a curvature (32) constructed to substantially correspond with an antihelix of user's ear (200).

19. A method of using an earphone cover (10) constructed for an earphone (100) wherein the earphone (100) is comprised of an ear bud (110) and a stem (120), wherein the ear bud (110) inserts into user's ear canal (210) and the stem (120) downwardly extends from the ear bud (110) wherein a primary speaker outlet (130) is formed on the ear bud (110), wherein the earphone cover (10) comprises an ear bud skin (20) and an extension (30), and wherein the ear bud skin (20) comprises a first opening (21) and a second opening (22), wherein the method includes the steps of inserting the earphone (100) into the earphone cover (10), the steps comprising:

the step of inserting the stem (120) into the first opening (21) and then into the second opening (22);

the step of respectively holding the stem (120) and the extension (30) and pulling and rotating the extension (30) away from the stem (120) to insert the ear bud (110) into the ear bud skin (20) through the first opening (21); and the step of adjusting the ear bud skin (20) to align an orientation of the ear bud skin (20) such that the ear bud skin (20) corresponds to the ear bud (110) and the first opening (21) surrounds the primary speaker outlet (130).

20. The method of claim 19, wherein the method further includes the steps of removing the earphone (100) from the earphone cover (10), the steps comprising:

the step of respectively holding the stem (120) and the extension (30);

the step of rotating the extension (30) in order for the ear bud (110) to be removed from the ear bud skin (20) through the first opening (21); and the step of holding the ear bud (110) and taking the stem (120) out of the second opening (22) and then out of the first opening (21).

* * * * *